US005197524A

United States Patent [19]

Clarke-Pounder et al.

[11] Patent Number: 5,197,524

[45] Date of Patent: Mar. 30, 1993

[54] APPARATUS AND METHOD FOR FEEDING STEAM INTO THE HOLLOW LONGITUDINAL STAVES OF A DEBARKING DRUM

[75] Inventors: Ian J. H. Clarke-Pounder, Nashua; Donald B. Johnson, Bedford, both of N.H.

[73] Assignee: Ingersoll-Rand Company, Woodcliff Lake, N.J.

[21] Appl. No.: 833,833

[22] Filed: Feb. 4, 1992

[51] Int. Cl.[5] ..... B27L 1/00

[52] U.S. Cl. ..... 144/342; 144/208 B; 144/380

[58] Field of Search ..... 144/2 R, 208 R, 208 B, 144/341, 342, 364, 380

[56] References Cited

U.S. PATENT DOCUMENTS 4,784,197 11/1988 Alander ..... 144/342

FOREIGN PATENT DOCUMENTS 650813 3/1979 U.S.S.R. ..... 144/208 D

*Primary Examiner*—W. Donald Bray

*Attorney, Agent, or Firm*—Robert F. Palermo

[57] ABSTRACT

A steam distributing valve in contact with the log feed end of a rotatable debarking drum is supported in such a manner that it is capable of moving slightly parallel to the drum axis in response to axial displacement of the drum. Full contact between the valve header and the drum end is maintained for sequentially providing pressurized steam to hollow longitudinal staves on the inner circumferential surface of the drum for thawing frozen logs for debarking.

14 Claims, 2 Drawing Sheets

APPARATUS AND METHOD FOR FEEDING STEAM INTO THE HOLLOW LONGITUDINAL STAVES OF A DEBARKING DRUM

BACKGROUND OF THE INVENTION

This invention relates generally to debarking of logs for pulp manufacture and more particularly to an apparatus and method for providing steam to the outside surface of the logs during their passage through the debarking drum, thereby heating the bark and improving debarking performance.

During winter, it is common for pulp logs which are stored outdoors prior to debarking to be in a frozen condition. This makes debarking difficult, and since it increases the time necessary for debarking to be accomplished, it also reduces the debarking throughput capacity of the mill.

Steaming frozen pulp logs is known to ease the removal of bark. A number of different steaming methods have been used. One steaming method for continuous drum debarking is to feed the frozen pulp logs through a stationary array of steam nozzles immediately prior to their entry into the debarking drum. This method has the disadvantage of being unable to preheat all surfaces of the feed logs during the debarking process. This is so because the logs in the feed chute are steamed as they pass the steam nozzles while sliding toward or into the debarking drum with little or no tumbling motion. The limited exposure of the log surface to the steam results in non-uniform thawing and a temporary surface warming which, in many instances, results in glazing, or icing, of the bark surface and, consequently, non-uniform debarking effectiveness.

Another method of steaming logs for debarking is to introduce the steam into the debarking drum in a substantially radial direction. This is accomplished by means of a compartmented annular steam distribution ring, in conjunction with a circumferential sliding valve which provides steam pressure through sequential steam ports in the drum wall. Commonly, the steam from the distribution ring compartments is distributed bidirectionally via hollow longitudinal ducts and thence into the drum through radial openings.

All steaming or thawing techniques presently employed provide some degree of success, but all also are subject to varying degrees of inadequacy. Out of roundness of the annular steam distribution ring can cause loss of steam pressure at entry into the drum interior and also leakage between the sliding valve and the ring as can wear of the mating surfaces of these two members. Steaming or water spraying in the log feed chute produces massive quantities of polluted water and may permit re-icing of some logs before they enter the debarking drum.

Also, because of its orientation, the circumferential sliding valve provides an opportunity for entrapment of foreign material between the valve surface and the annular steam distribution ring. This compromises the seal integrity at the contact interface between these two members. In addition, wear of the circumferential sliding valve will prevent closure of the clearance gap between the ring and valve necessary to minimize steam leakage and loss of steam pressure. Drain back of condensate from the ducts within the drum will find its way into the steam distribution ring and from there into the steam valve. This necessitates a drain off provision which, in a steam pressurized valve, may make it difficult to maintain desired steam pressure. Finally, introduction of the steam through the steam distribution ring at an intermediate location along the length of the debarking drum makes it difficult to ensure desired distribution of steam in both longitudinal directions within the debarking drum. This is a consequence of the steam having to travel in two opposite directions through the ducts from the steam distribution ring.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a steam distributing valve for sequentially introducing steam axially into the ends of hollow longitudinal log-tumbling staves which are attached to the interior wall of a rotating debarking drum. The steam is introduced at the log feeding end of the drum including a manifold arranged for sequentially providing pressurized steam communication with an open end of one or more of the staves, each stave having one or more apertures along its length for communication with the inside of the embarking drum; and pressurized steam feeding means for pressurizing the manifold.

The foregoing and other aspects will become apparent from the following detailed description of the invention when considered in conjunction with the accompanying drawing figures.

DETAILED DESCRIPTION

Figure 1:
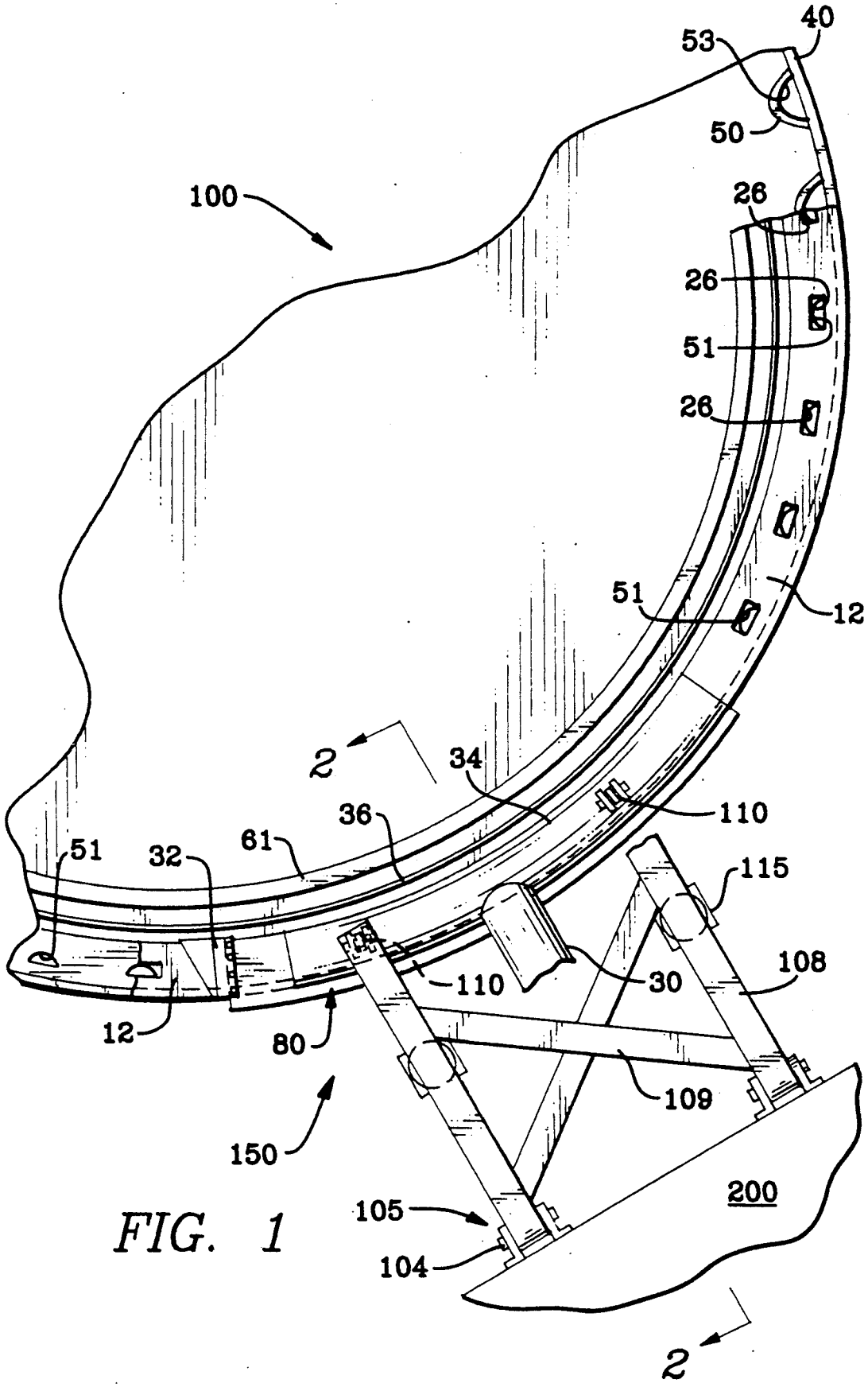
FIG. 1 is a fragmentary end view of the log feed end of a debarking drum fitted with the present invention.

FIG. 1 is a fragmentary elevation end view of a debarking drum 100 incorporating the present invention. Inlet ring 61 defines the drum inlet opening diameter, and is fixed to drumhead 60. Drumhead 60 projects inwardly from drum shell 40 and is fixed to the ends of log-tumbling staves 50 to cover their ends and provide a flat annular surface at the end of drum 100. Steam passages 51 are provided in head 60 and are aligned and connected, one with each stave at its end adjacent to the debarking drum inlet to communicate with the hollow interior of the longitudinal staves. A wear ring 12 shown as a preferred embodiment is fixed to head 60 and is provided with steam passages 26 to communicate through steam passages 51 of head 60, with the hollow interior of staves 50 through stave openings 53 at the inlet end of drum 100.

Valve 150, mounted on the ground or other permanent supporting structure, is placed axially upstream of drumhead 60 in a position to cooperate with stave inlet openings 53 through head passages 51 and, if used, steam passage 26 of wear ring 12 in its preferred embodiment. Valve 150 is preferably provided with two support legs 108 and cross braces 109 to assure structural rigidity. Joint connectors 105 are mounted on base 200 and are connected to support legs 108 by pivot pins 104 to permit articulation of support legs 108 with respect to base 200. At the top of legs 108 are flexible joints 110 upon which is mounted steam manifold 80.

Manifold 80 consists of header 34 which is a curved hollow member which is pressurized by steam through steam inlet 30 and which has at least on outlet port through which steam is fed through apertures 26 of wear ring 12 to stave openings 53. Header 34 is maintained in contact with wear ring 12 by the biasing action of cylinders 115 acting upon support legs 108. At the leading edge of manifold 80, with respect to the travel of wear ring 12 past header 34, is shown an angled plowing wear ring doctor 32 which is a scraper provided to remove foreign material from the flat surface of wear ring 12 so that it will not interfere with sealing between header 34 and wear ring 12. Wood, bark, dirt and other foreign materials being fed into the drum inlet is prevented from falling onto the valve by a shield ring 36, projecting axially upstream from drumhead 60. If trapped within the interface between header 34 and wear ring 12, such detritus could interfere with sealing.

Figure 2:
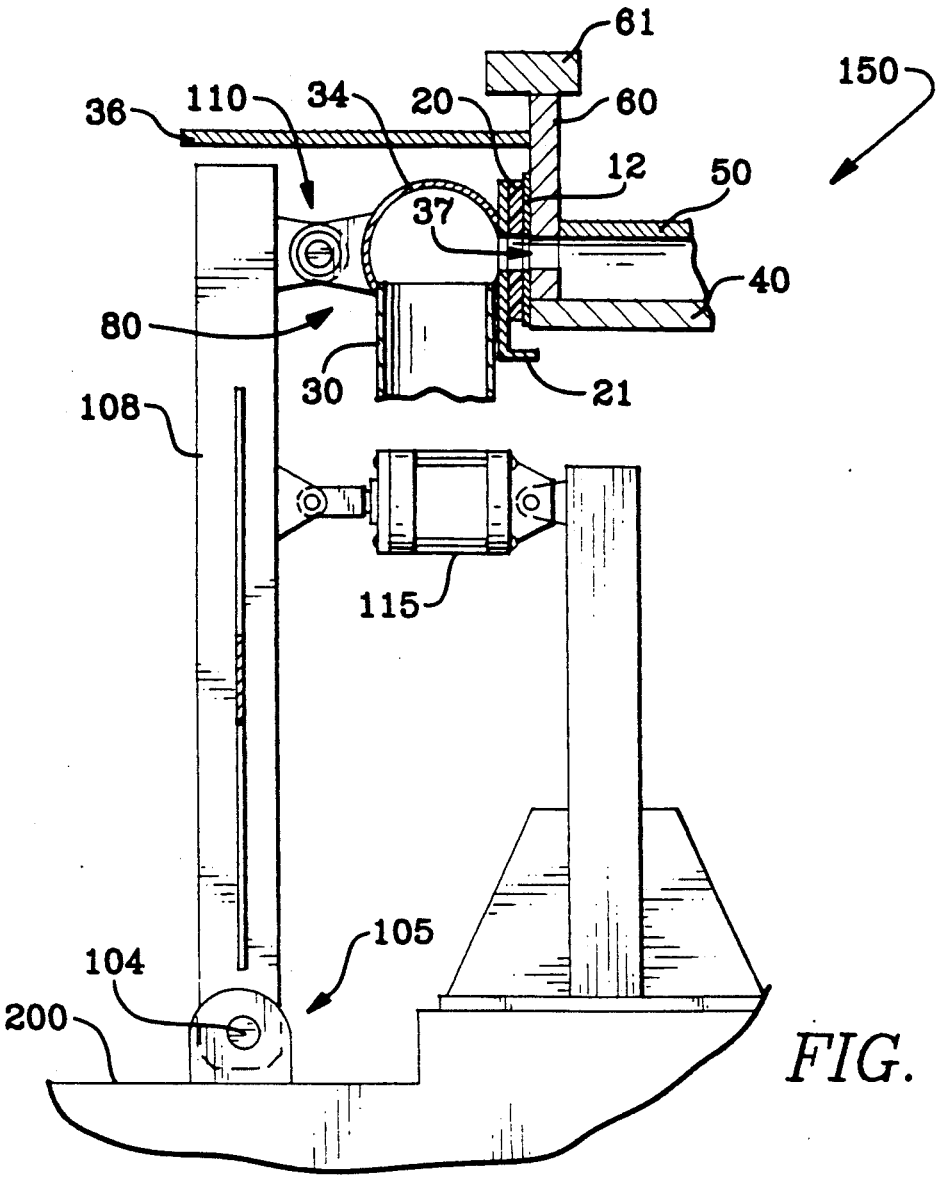
FIG. 2 is a partially sectioned side elevation view of the valve of the present invention.

FIG. 2 is a side elevation view of valve 150 presented to further illustrate features of the valve. Inlet ring 61 is surrounded by and secured to head 60 which in turn projects inwardly from drum shell 40. Head 60 is permanently secured to shell 40 and provides passages through which steam may travel to the ends of staves 50. Shield ring 36 is fixed to and projects axially outwardly from the log feeding side of head 60 such that shield 36 protects valve 150 from falling debris.

Wear ring 12 overlays and is fixed to head 60 to provide a smooth flat face against which face seal 20, which is fixed to seal base 21, can provide a positive seal against steam pressure. Seal base 21 is fixed to header 34 surrounding steam outlet port 37 of header 34 to provide steam communication through apertures 26 of wear ring 12 and 51 of drumhead 60 to stave opening 53 of stave 50. Header 34 is pressurized through steam inlet 30 from a flexible steam connection (not shown). Flexible joints 110 at the top of support legs 108 provide articulable support to manifold 80. Legs 108 are connected by pivot pins 104 to flex joints 105 mounted on base 200 so that valve 150 has the two degrees of articulation freedom required to maintain face seal 20 parallel to wear ring 12 during axial displacements of drum shell 40. Contact between face seal 20 and wear ring 12 is maintained by means of the bias provided by cylinders 115. These cylinders are the preferred biasing apparatus but springs or other devices may be appropriate in some installations.

Figure 3:
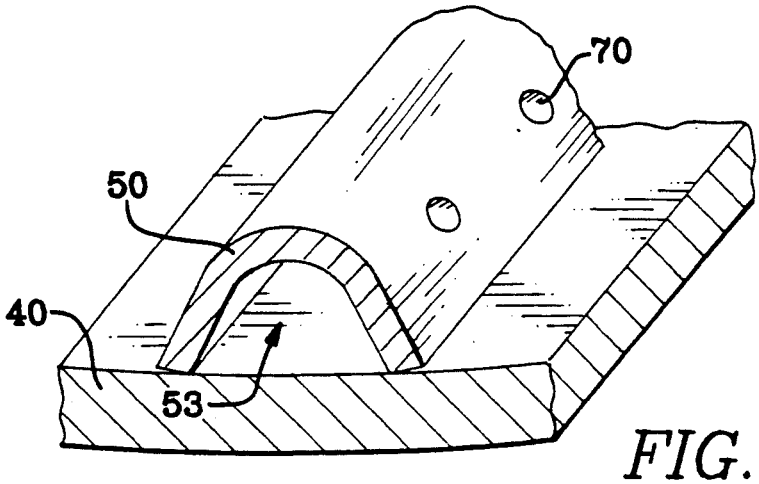
FIG. 3 is a fragmentary perspective view of a single stave.

FIG. 3 presents a fragmentary partially sectional perspective view of a hollow longitudinal stave 50 secured to the drum shell 40. Save opening 53 provides entrance to a pipelike path along which steam can be axially fed in the debarking drum 100. Distributed along stave 50 are steam injection openings 70 which are preferably oriented substantially, tangentially throughout the length of the drum or at different regions along the length of the drum for releasing steam into the interior of debarking drum 100. The number and spacing of injection openings 70 depends upon the size of debarking drum 100 and its debarking capacity. Adjustment of steam thermal input according to the degree of defrosting and/or de-icing required is readily accomplished by means of a pressure control valve (not shown) attached to the supply line to steam inlet 30 for controlling steam pressure and flow. Changes in steaming capacity may also be accomplished by changing seal base 21 and face seal 20 on header 34 in order to vary the duration of time during which steam may flow into apertures 26 and 51 and, hence, vary and control the maximum steam throughput capacity for the valve system.

What is claimed is:

1. A valve for introducing steam axially into ends of hollow longitudinal log-tumbling staves in a rotatable debarking drum, comprising:

manifold means at a log feed end of said debarking drum arranged for sequentially providing pressurized steam communication with an open end of one or more of said staves;

means for providing freedom of movement for said manifold means parallel tot he axis of rotation of said rotatable debarking drum; and steam feeding means for pressurizing said manifold means.

2. The valve of claim 1, further comprising:

biasing means for maintaining contact between said manifold means and said log feed end of said debarking drum during axial displacements of said drum.

3. The valve of claim 1, wherein the manifold means comprises a curved header having a radius of curvature equal to the radius of the locus of the staves of the debarking drum and having at least one steam outlet port directed toward steam passageways in a debarking drumhead, said passageways being in fixed communication with open axial ends of the staves; and a steam inlet to said header, said inlet being flexibly connected to a steam supply.

4. The valve of claim 3, wherein the manifold means further comprises means for sealing an interface between the header and the debarking drumhead to prevent leakage of steam from the steam passageways.

5. The valve of claim 1, wherein the means for providing freedom of movement for said manifold means comprises a pedestal which flexibly supports at least one manifold mounting column, said column being connected to said manifold means by articulable means for maintaining flat contact between said manifold means and said log feed end of said debarking drum during axial displacement of said debarking drum.

6. The valve of claim 1, wherein the steam feeding means further comprises pressure regulating means for adjusting feeding pressure of steam to said manifold means.

7. The valve of claim 3, wherein the manifold means further comprises scraper means for maintaining said barking drum head free of foreign objects as the head rotates into communication with the seal means on the header.

8. The valve of claim 3, wherein said debarking drumhead further comprises a replaceable wear ring means for providing increased valve and drumhead life.

9. In a rotatably driven pulp log debarking drum of the type having an interior circumferential surface with hollow longitudinal log-tumbling staves, the improvement, in combination with said hollow longitudinal log-tumbling staves, comprising:

manifold means at a log feed end of said debarking drum arranged for sequentially providing pressurized steam communication with an open end of one or more of said staves; and shield means positioned at the log fed end of said debarking drum for preventing foreign objects from falling onto said manifold means.

10. The improvement of claim 9, further comprising: steam injection openings through which steam pressure within said hollow longitudinal log-tumbling staves escapes in a substantially tangential direction into the interior of the debarking drum.

11. The improvement of claim 9, wherein, except when in contact with the manifold means, the open inlet ends of the log-tumbling staves are unobstructed to provide free drainage of any condensate which forms within said staves.

12. A method for injecting steam into a log debarking drum through one or more hollow longitudinal log-tumbling staves affixed to an interior surface of said drum and having longitudinally spaced apertures arranged to tangentially discharge steam at the drum interior, including the steps of:

providing a flat annular drumhead at a log feed end of the drum, said drumhead having at least one steam passageway aligned with an axial end opening of one or more selected staves;

providing a manifold means, having axial freedom of movement and axial biasing means for maintaining contact with said annular drumhead during slight axial displacements of said debarking drum for sequentially enabling pressurized steam communication with one or more of said steam passageways; and pressurizing said manifold means with steam.

13. The method of claim 12, including the further step of:

providing a sealing means between said drumhead and said manifold means for preventing leakage of steam from between the drumhead and the manifold.

14. A debarking drum for removing bark from pulp-making logs, comprising:

a rotatable hollow cylindrical drum having inner and outer circumferential surfaces, an open inlet end, an open outlet end, and longitudinal hollow log-tumbling staves affixed to the inner surface and extending substantially the full working length of said drum;

means for introducing pressurized steam axially into open ends of one or more of said staves for unidirectionally feeding said steam along the length of said staves;

a plurality of steam injection openings distributed along the length of the steam fed staves and oriented to provide substantially tangential injection of steam into said drum;

log feed means for supplying logs to the inlet end of said drum; and log removal means for transporting logs from the outlet end of said drum.

* * * * *